US007552580B2

(12) United States Patent
Xu et al.

(10) Patent No.: US 7,552,580 B2
(45) Date of Patent: Jun. 30, 2009

(54) METHOD AND APPARATUS FOR PRODUCING HIGH QUALITY YARN ON A RING-SPINNING MACHINE

(75) Inventors: Weilin Xu, Wuhan (CN); Zhigang Xia, Wuhan (CN); Wenxiang Ye, Wuhan (CN); Weigang Cui, Wuhan (CN); Wenbin Li, Wuhan (CN); Shangyong Zhang, Wuhan (CN)

(73) Assignee: Wuhan University of Science & Engineering, Wuhan, Hubei (CN)

( * ) Notice: Subject to any disclaimer, the term of this patent is extended or adjusted under 35 U.S.C. 154(b) by 10 days.

(21) Appl. No.: 11/823,451

(22) Filed: Jun. 26, 2007

(65) Prior Publication Data

US 2008/0155786 A1 Jul. 3, 2008

(30) Foreign Application Priority Data

Dec. 28, 2006 (CN) ..... 2006 1 0166509

(51) Int. Cl.
*D01H 7/52* (2006.01)
*D01H 13/28* (2006.01)

(52) U.S. Cl. ..... 57/75; 57/282; 57/352

(58) Field of Classification Search ..... 57/75, 57/120, 121
See application file for complete search history.

(56) References Cited

U.S. PATENT DOCUMENTS 3,589,120 A * 6/1971 Phillips ..... 57/310
3,678,676 A * 7/1972 Rothwell et al. ..... 57/284
3,777,465 A * 12/1973 Buzano ..... 57/282
6,332,311 B1 * 12/2001 Todo et al. ..... 57/350

* cited by examiner

*Primary Examiner*—Shaun R Hurley
(74) *Attorney, Agent, or Firm*—Raymond Y. Chan; David and Raymond Patent Firm

(57) ABSTRACT

A method of producing a high quality of yarn by an iron-heating apparatus, including the steps of: guiding a yarn to pass between upper and lower rollers, wherein the yarn is exited at a front nip in a twisting triangle area; guiding the yarn to enter to a groove of a heating main body of the iron-heating apparatus; heating the yarn along the groove to reduce a rigidity of the yarn so as to allow the yarn to be easily twisted to form an improved yarn with high quality; and enwrapping the improved yarn on a spun yarn tube. In addition, a counter frictional force is applied at the yarn through walls of the groove such that fiber on a surface of the yarn is further twisted to the yarn for minimizing hairiness.

17 Claims, 3 Drawing Sheets

METHOD AND APPARATUS FOR PRODUCING HIGH QUALITY YARN ON A RING-SPINNING MACHINE

BACKGROUND OF THE PRESENT INVENTION

1. Field of Invention

The present invention represents a method and apparatus for producing yarn, and more particularly to a method and apparatus for producing yarn of high quality, wherein an iron-heating apparatus is installed on existing ring spinning machines to achieve the desired quality of yarn.

2. Description of Related Arts

Hairiness is one of important indexes to measure the quality of yarn. Hairiness can affect not only subsequent efficiency of yarn production, but also the quality and appearance of the final product. Reducing hairiness is very significant especially when shuttle-free machines are widely used today.

Generally speaking, hairiness is generated during the process of yarn production, wherein hairiness will be increased in spinning process and reduced in sizing process. With regard to ring spinning machines, fibers are twisted in a so-called twisting triangle area so that they can be effectively enwrapped into yarn during spinning, and yarn hairiness is consequently generated. It is mainly because the yarn twisted in the front roller in the twisting triangle area is under torques. Torque of differing magnitudes is exerted on the outer and inner layers of the fiber. When the fiber is spun, if the torque is not large enough to overcome the rigidity of the fiber and made it bend to the center of the yarn, the fiber will become hairiness on the surface of the yarn. Moreover, hairiness can be formed at the very end of the fiber because the tension suddenly disappears at the exit of the twisting triangle area and the very end of the fiber can no longer be twisted into the fiber. It is generally believed that the physical property of the fiber is an important factor of hairiness in the process of yarn spinning. Hairiness can be reduced by longer or thinner fibers, enhancing the fineness of the fibers, increasing the number of twist of yarn or lowering the rigidity of the fiber.

Extensive researches regarding controlling hairiness have been conducted by many scholars. Two controlling methods are usually adopted: one is so-called ordinary methods and the other is the method of using hairiness-reducing equipment. Ordinary methods involve the process of optimization of certain industrial parameters or adopting some new techniques of yarn spinning to reduce hairiness, such as increasing the number of twist of yarn, lowering the speed of yarn spinning, appropriately increasing the tension of yarn spinning or decreasing the relaxation parameter in the area of spun yarn, or adopting the technology of compact yarn. Currently, the research is focused on adding some simple hairiness-reducing equipment on traditional ring spinning machines. An air-injection method is used so far in which the air-injection apparatus is installed between front roller and guide wire, so that the eddy of air flow can force the hairiness to stay close to the surface of yarn. This technique has been disclosed in "method and apparatus yarn treatment" patented on Apr. 10, 1974 (U.S. Pat. No. 4,148,179), and "method and apparatus for modifying spun textile yarn" patented on Aug. 22, 1989 (U.S. Pat. No. 5,263,311). Major difference in above researches is that each air-injection apparatus generates different directions of air flow which has different hairiness-reducing effect. However, these apparatuses can only be installed after the twisting triangle area, meaning that the hairiness has already been formed and it can only be forced to stay close to the surface of yarn, but cannot be eliminated. Furthermore, specific air compressors and pipelines are necessary for these apparatuses. It can greatly affect the operative in a textile mill when such air-injection apparatus is also installed on the yarn equipment.

SUMMARY OF THE PRESENT INVENTION

The present invention provides an effective method to reduce hairiness and enhance the quality of yarn. Specifically, this invention is to introduce an iron-heating apparatus in the twisting triangle area.

In the present invention, the iron-heating apparatus is located in front of a front roller and a front leather roller on a ring spinning machine and the fiber is heated with high temperature at the exit of a front nip of the twisting triangle area. Specifically, the fiber directly enters the iron-heating apparatus from the exit of the front nip formed by the front leather roller and the front roller. The working temperature is between 60 and 300 centigrade. After being heated, the fiber goes through a guide wire, a traveler and a ring, and is then winded on a spun yarn tube. It is worth mentioning that the front roller and the front leather roller are provided to guide the fiber into the twisting triangle area.

The method comprises a base, a heating main body, a heat element, a temperature testing sensor and a thermal insulation layer. The heat element is positioned in the heating main body and the temperature testing sensor is either in the heating main body or on the surface thereof. The heating main body also includes an arc groove which is bell-mouthed and gradually shrunk toward the direction of yarn movement, wherein the fiber becomes more tightened and the diameter of the yarn decreases. More specifically, the modulus of the fiber is decreased after being heated and the fiber would more easily be collected and twisted together. The ratio of the width of the opening of the bell-mouthed groove k1 and the corresponding width of the fiber in the twisting triangle area is 1:1 to 1:1.5, while the ratio of the width of the groove k2 and the diameter of the yarn is 1:1.05 to 1:1.5. The shape of the bottom of the groove is semicircular and the depth of the groove H equals to k2. The heating main body is covered by the thermal insulation layer, and the heating main body is installed on the base.

The opening of the heating main body is close to the front nip from which the fiber comes, and then the fiber enters the heating main body and stays close to the groove of the heating main body along which the fiber moves forward. The heat element can be electronic heating wire (i.e. resistance) or heating mediums in the hollow tube. The bottom of the groove of the heating main body can be carved with features which are compatible with the twisting direction of the yarn. The heating main body in the iron-heating apparatus can be made from the materials which are abrasion-proof, thermal conductive and insulated, such as PTFE, ceramics and glass. The base and the heating main body in the iron-heating apparatus can be fabricated together as a whole.

According to the present invention, the fiber come from the front nip is directly heated by the iron-heating apparatus. The rigidity of the fiber, especially in the twisting triangle area, is reduced so that the fiber can subsequently be twisted more easily and hairiness can be avoided, especially long hairiness (longer than 3 mm) generated in subsequent processes. The friction of the groove can force hairiness to stay close to the surface of the fiber and significantly reduce the amount of hairiness. Meanwhile, the heating process is also a thermal setting process of the fiber and can significantly reduce the "kinking" phenomenon. The method in the present invention is an open structure, which has little interference to subsequent human operation, consumes less energy and is easy to install.

These and other objectives, features, and advantages of the present invention will become apparent from the following detailed description, the accompanying drawings, and the appended claims.

DETAILED DESCRIPTION OF THE PREFERRED EMBODIMENT

Figure 1:
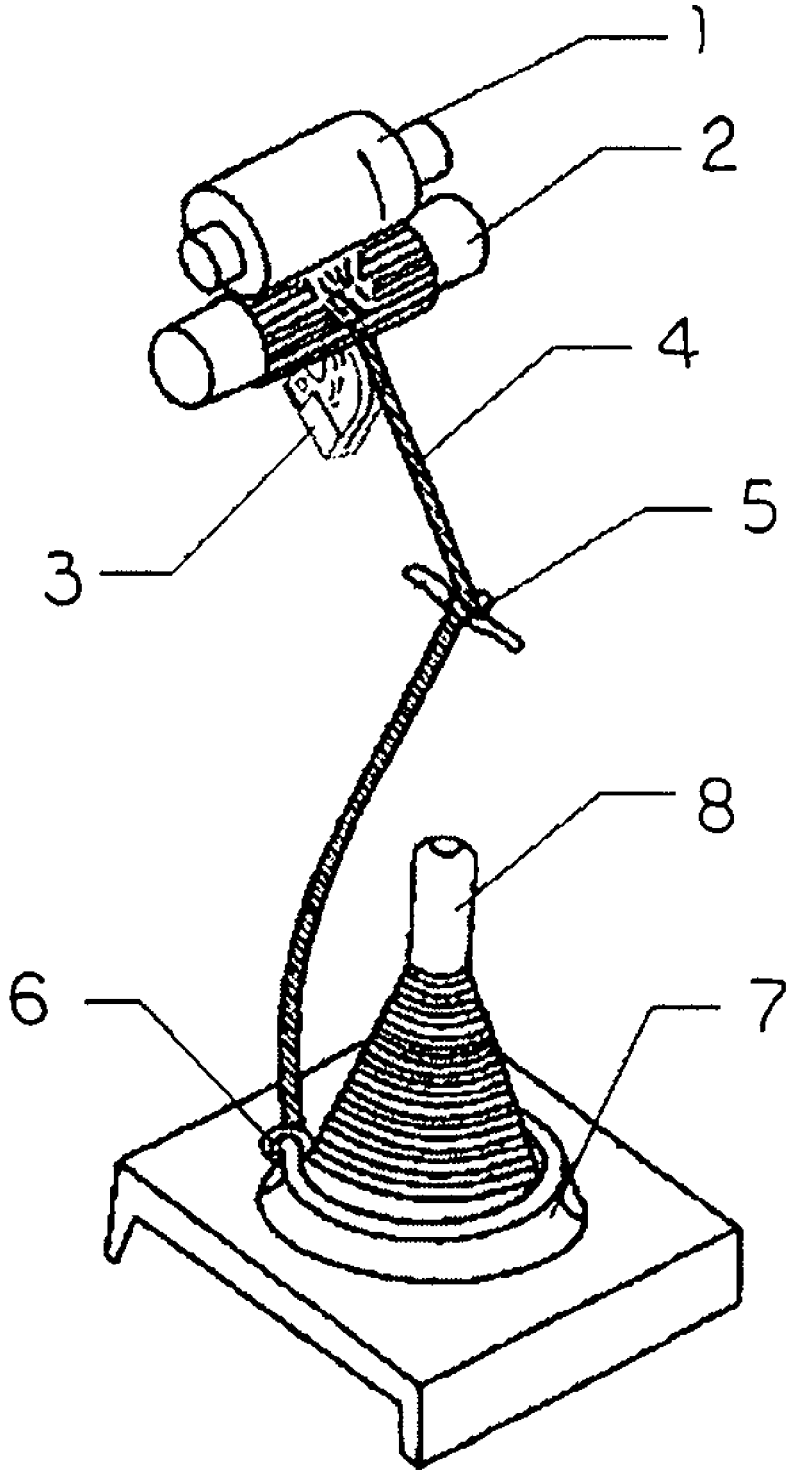
FIG. 1 is a schematic representation of components of the device in the present invention

The present invention is further illustrated along with the figures. As stated previously, it is generally believed that the physical property of the fiber is an important factor affecting hairiness in the process of yarn spinning. When the torque exerted on the fiber in the twisting triangle area is smaller than the rigidity of the fiber itself, hairiness is likely to form on the surface of the fiber. The present invention is based on the principle that the rigidity of the fiber is reduced with the increase of temperature. By placing an iron-heating apparatus 3 adjacent to an upper roller 1 and a lower roller 2, the fiber is heated with high temperature at the exit of a front nip and its rigidity is reduced so that the fiber can more easily be twisted. Meanwhile, to avoid hairiness (especially long hairiness) and improve the quality of yarn, the fiber in the twisting triangle area and movement of the surface fiber of yarn is controlled by the counter frictional force exerted on the fiber in the groove of the iron-heating apparatus 3. It is worth mentioning that the upper roller 1 and the lower roller 2 are provided to guide the fiber into the twisting triangle area. The principle of the heating process is illustrated as follows. The upper roller 1 (front leather roller) and the lower roller 2 (front roller) are used to guide the yarn before the yarn is spun. The yarn is guided to pass through the upper and lower rollers 1, 2 at the front nip thereof within the twisting triangle area and to the groove of the heating main body 10 of the iron-heating apparatus 3 in which the fiber moves along and stays close to the wall of the groove. The heating main body 10 of the iron-heating apparatus 3 works with a heat element 11 to heat the fiber at certain working temperature and a temperature testing sensor 12 to ensure the yarn is heated within the working temperature. Also, the groove in the heating main body 10 of the iron-heating apparatus 3 provides a counter frictional force to the surface of the fiber. After heated by the iron-heating apparatus 3, the fiber goes through a guide wire 5, a traveler 6 and a ring 7, and then is enwrapped on a spun yarn tube 8.

FIG. 1 is the schematic representation of components of the device in the present invention. As illustrated in FIG. 1, the iron-heating apparatus 3 comprises the upper roller 1, the lower roller 2, a guide wire 5, a traveler 6, a ring 7 and a spun yarn tube 8. The iron-heating apparatus in the present invention is located in front of the lower roller 2, close to the front nip formed at the upper and lower rollers 1, 2. The fiber coming from the front nip directly enters the iron-heating apparatus 3 in which the working temperature is ranging from 60 to 300 centigrade. The working temperature is based on the material of yarn. After heating, the fiber goes through the guide wire 5, the traveler 6 and the ring 7, and then is enwrapped on the spun yarn tube 8.

Figure 2:
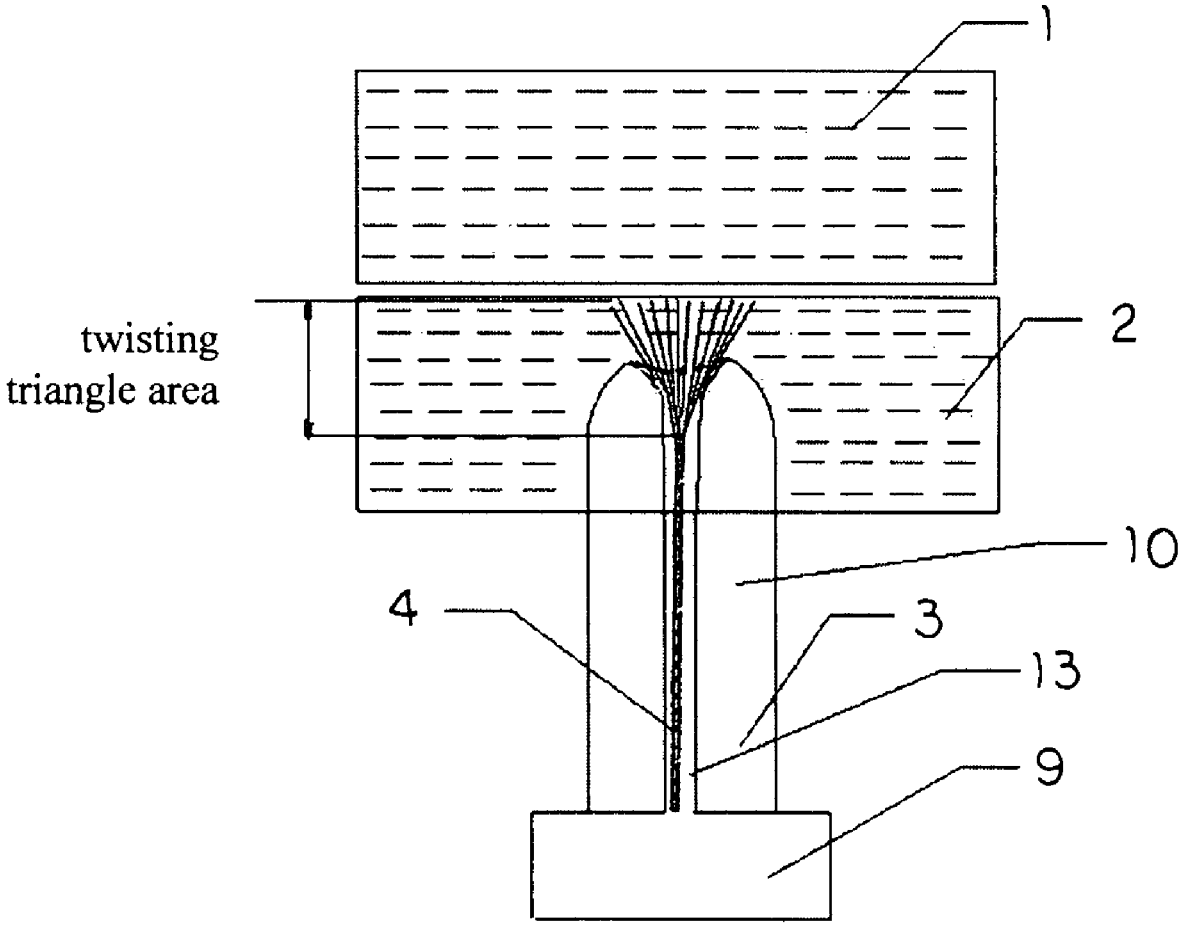
FIG. 2 is a schematic representation of working principles in the present invention

FIG. 2 is the schematic representation of working principles in the iron-heating apparatus 3 of the present invention to incorporate with the upper roller 1 and a lower roller 2 to guide the yarn 4. The fiber comes out from the front nip formed at the upper and lower roller 1, 2 is twisted to form yarn. Before becoming yarn, the fiber coming out from the front nip enters a twist-free region which is called the twisting triangle area. The tip of the iron-heating apparatus 3 of the present invention goes into the twisting triangle area. The fiber coming out from the front nip moves into the groove in the iron-heating apparatus 3 and stays close with the bottom of the groove, and the fiber can be heated. Since the yarn is moving forward while being twisted, a counter frictional force exists between the bottom of the groove in the iron-heating apparatus 3 and the yarn, and thus the hairiness is avoided.

Figure 3:
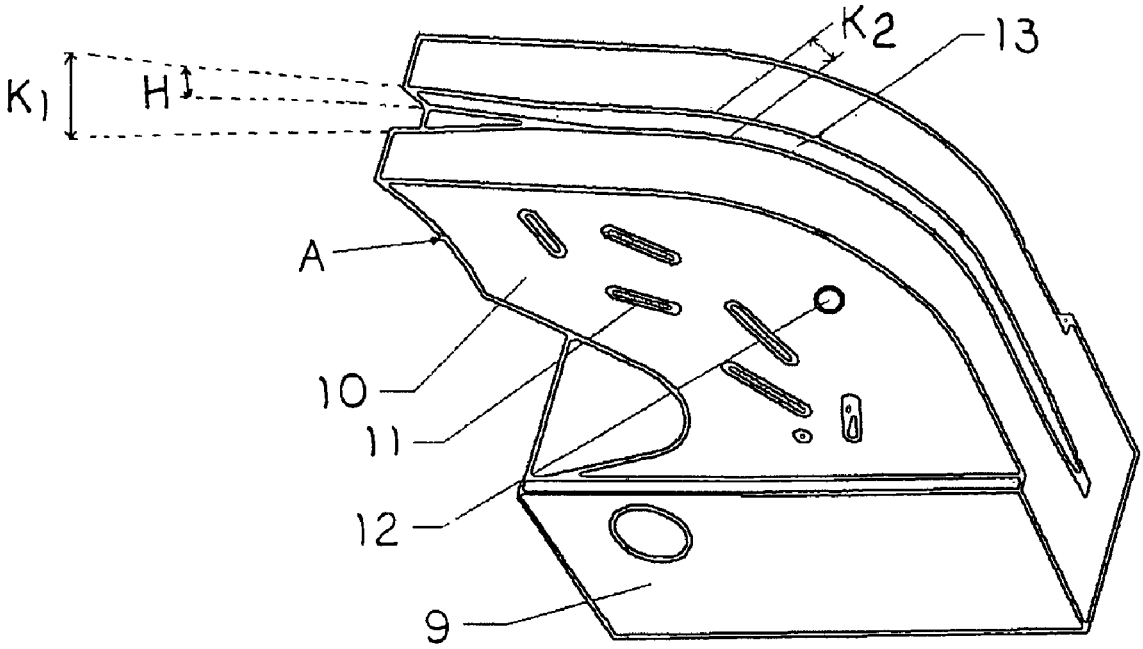
FIG. 3 is a three-dimension schematic representation of the device in the present invention
Figure 4:
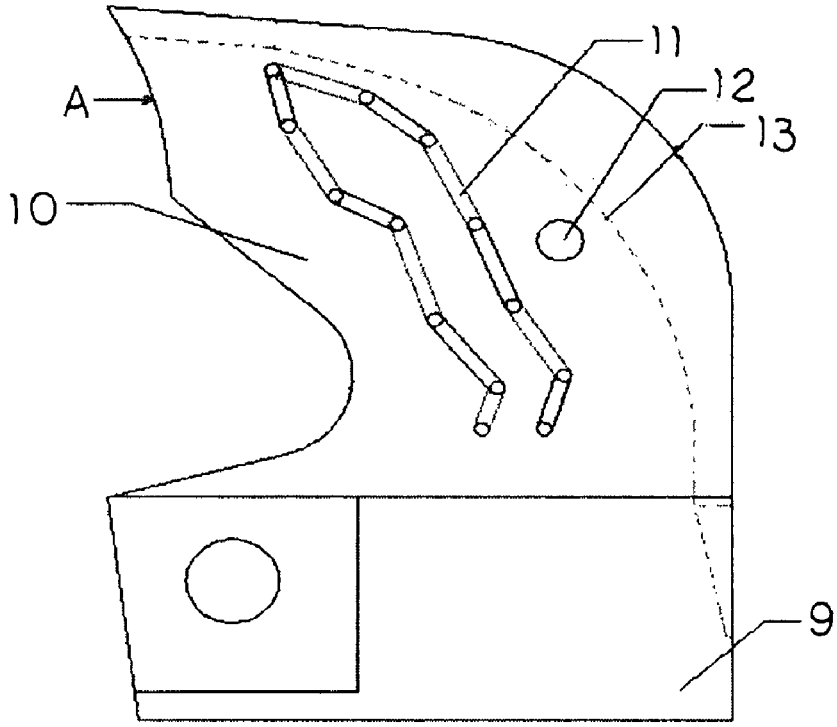
FIG. 4 is a lateral view of the iron-heating apparatus in the present invention

FIG. 3 is a three-dimension schematic representation of the device in the present invention. FIG. 4 is a lateral view of the iron-heating apparatus 3 in the present invention. As illustrated in FIG. 4, the iron-heating apparatus 3 comprises a base 9, the heating main body 10, the heat element 11 supported in the heating main body 10, the temperature testing sensor 12 supported in the heating main body 10 to detect the working temperature and a thermal insulation layer. The heat element 11 is located in the heating main body 10 and the temperature testing sensor 12 is placed either in the heating main body 10 or on the surface thereof. The heating main body 10 also includes the arc-shaped groove 13 that the entrance portion of the groove has a width gradually reducing from an opening of the entrance portion, wherein the fiber becomes more tightened and the diameter of the yarn decreases. More specifically, the modulus of the fiber is decreased after being heated and the fiber would more easily be collected and twisted together. The opening of the entrance portion of the groove 13 is aligned with the front nip of the upper and lower rollers 1, 2. The ratio of the width of the opening of the bell-mouthed groove k1 and the corresponding width of the fiber in the twisting triangle area is 1:1 to 1:1.5. The ratio of a width of the guiding portion of the groove k2 and the diameter of the yarn is 1:1.05 to 1:1.5, wherein the guiding portion of the groove 13 is alignedly extended from the entrance portion of the groove 13. The shape of the bottom of the groove is semicircular and the depth of the groove H equals to the width of the guiding portion of the groove k2. To increase control and friction of the fiber, the bottom of the groove of the heating main body 10 can be carved with features which are compatible with the twisting direction of yarn. The outer surface of the heating main body 10 is covered by the thermal insulation layer, and the heating main body 10 is fixed on the based 9.

The method 3 is installed in front of the upper roller 1 and the lower roller 2. The opening of the heating main body 10 of the iron-heating apparatus 3 is close to the front nip formed by the upper roller 1 and the lower roller 2. Surface A of the heating main body 10 facing towards the upper roller 1 is an arc surface having a curvature corresponding to the upper roller 1 or the lower roller 2. The fiber coming from the nip enters into and stays close to the groove 13 of the heating main body 10, and moves forward along the bottom of the groove.

The heat element 11 is located in the heating main body 10. The heat element 11, externally connected to a heat control system, can be electronic heating wire (i.e. resistance) or heating medium in the hollow tube. The temperature testing sensor 12, electrically connected to the switch of temperature control system, is located either in the heating main body 10 or on the surface thereof. The heat element 11 and the temperature testing sensor 12 work through the temperature control system to keep the heating main body 10 at working temperature between 60 and 300 centigrade. The exact working temperature depends on the materials of the fibers. For example, working temperature is 100 to 120 centigrade for polyester fiber while it is 180 to 280 centigrade for cotton.

The heating main body 10 in the iron-heating apparatus 3 can be made from the materials which are abrasion-proof, thermal conductive and insulated, such as PTFE, ceramics and glass. The base 9 in the iron-heating apparatus 3 has installation apertures which enable the base 9 and the heating main body 10 to be fabricated together as a whole. The heating main body 10 is covered by the thermal insulation layer which is used to prevent the loss of thermal energy, and then lower the consumption of energy. The thermal insulation layer can be some thermal insulation materials coated or attached on the surface of the heating main body. An outer covering with the thermal insulation layer can be fabricated according to the shape of the heating main body 10.

What is claimed is:

1. A method of producing a high quality of yarn by an iron-heating apparatus comprising a heating main body and having a twisting triangle area, wherein said method comprises the steps of:

(a) guiding a yarn fiber to pass between an upper and a lower roller, wherein said yarn fiber is guided to exit at a front nip in said twisting triangle area;

(b) guiding said yarn fiber to enter to a groove of said heating main body of said iron-heating apparatus;

(c) heating said yarn fiber along said groove to reduce a rigidity of said yarn fiber so as to allow said yarn to be easily twisted to form an improved yarn fiber with high quality, wherein modulus of said yarn fiber is decreased after said heating so as to allow said yarn fiber to be easily collected and twisted into a predetermined pattern, wherein said yarn fiber is heated at a working temperature between approximately 60° C. and approximately 300° C.; and (d) enwrapping said improved yarn fiber on a spun yarn tube.

2. The method, as recited in claim 1, wherein said step (b) comprise the steps of:

(b.1) guiding said yarn fiber to enter to an entrance portion of said groove through an opening thereof;

(b.2) guiding said yarn fiber to enter from said entrance portion to a guiding portion of said groove which is extended from said entrance portion thereof, wherein said entrance portion of said groove has a width gradually reducing from an opening to said guiding portion; and (b.3) guiding said yarn fiber to enter from said guiding portion to an exiting portion of said groove.

3. The method, as recited in claim 1, wherein said step (c) comprises the step of:

(c.1) twisting said yarn fiber along said groove when said yarn fiber is moving forward; and (c.2) applying a counter frictional force at said yarn fiber through walls of said groove for minimizing hairiness.

4. The method, as recited in claim 2, wherein said step (c) comprises the step of:

(c.1) twisting said yarn fiber along said groove when said yarn fiber is moving forward; and (c.2) applying a counter frictional force at said yarn fiber through walls of said groove for minimizing hairiness.

5. The method, as recited in claim 2, wherein a ratio of a width of said opening of said groove and a width of said twisting triangle area is 1:1 to 1:1.5, wherein a ratio of a width of said guiding portion of said groove and a diameter of said yarn fiber is 1:1.05 to 1:1.5, wherein a depth of said groove equals to said width of said guiding portion.

6. The method, as recited in claim 3, wherein a ratio of a width of said opening of said groove and a width of said twisting triangle area is 1:1 to 1:1.5, wherein a ratio of a width of said guiding portion of said groove and a diameter of said yarn fiber is 1:1.05 to 1:1.5, wherein a depth of said groove equals to said width of said guiding portion.

7. The method, as recited in claim 4, wherein a ratio of a width of said opening of said groove and a width of said twisting triangle area is 1:1 to 1:1.5, wherein a ratio of a width of said guiding portion of said groove and a diameter of said yarn fiber is 1:1.05 to 1:1.5, wherein a depth of said groove equals to said width of said guiding portion.

8. The method, as recited in claim 1, wherein the iron-heating apparatus comprises:

a main heating body having a groove and an opening for guiding a yarn fiber passing from a front nip in a twisting triangle area, an entrance portion communicating with said opening, an exiting portion, and a guiding portion alignedly extended from said entrance portion to said exiting portion for guiding said yarn fiber passing along said groove from said entrance portion to said exiting portion through said guiding portion so as to twist said yarn fiber along said groove when said yarn fiber is moving forward; and a heating element supported in said main heating body for generating heat along said groove for reducing a rigidity of said yarn fiber when said yarn fiber passes through said groove so that modulus of said yarn fiber is decreased after said heating so as to allow said yarn fiber to be easily collected and twisted into a predetermined pattern to form an improved yarn fiber with high quality, wherein said main heating body is adapted to heat said yarn fiber at a working temperature between approximately 60° C. and approximately 300° C. and apply a counter frictional force at said yarn fiber through walls of said groove for minimizing hairiness thereof.

9. The method, as recited in claim 8, wherein said entrance portion of said groove has a width gradually reducing from an opening to said guiding portion.

10. The method, as recited in claim 8, wherein a ratio of a width of said opening of said groove and a width of said twisting triangle area is 1:1 to 1:1.5, wherein a ratio of a width of said guiding portion of said groove and a diameter of said yarn fiber is 1:1.05 to 1:1.5, wherein a depth of said groove equals to said width of said guiding portion.

11. The method, as recited in claim 9, wherein a ratio of a width of said opening of said groove and a width of said twisting triangle area is 1:1 to 1:1.5, wherein a ratio of a width of said guiding portion of said groove and a diameter of said yarn fiber is 1:1.05 to 1:1.5, wherein a depth of said groove equals to said width of said guiding portion.

12. The method, as recited in claim 10, wherein said groove has an arc-shape curving from said guiding portion to said exiting portion for guiding said yarn fiber passing therethrough.

13. The method, as recited in claim 11, wherein said groove has an arc-shape curving from said guiding portion to said exiting portion for guiding said yarn fiber passing therethrough.

14. The method, as recited in claim 12, further comprising a temperature testing sensor supported in said heating main body to detect a working temperature for heating said yarn fiber along said groove.

15. The method, as recited in claim 13, further comprising a temperature testing sensor supported in said heating main body to detect a working temperature for heating said yarn fiber along said groove.

16. The method, as recited in claim 14, wherein said heating main body is arranged for positioning adjacent to upper and lower rollers that said yarn fiber is passes through said upper and lower rollers at a front nip in said twisting triangle area, wherein said heating main body has a curved surface facing towards said lower roller, wherein said curved surface has a curvature corresponding to a curvature of said lower roller.

17. The method, as recited in claim 15, wherein said heating main body is arranged for positioning adjacent to upper and lower rollers that said yarn fiber is passes through said upper and lower rollers at a front nip in said twisting triangle area, wherein said heating main body has a curved surface facing towards said lower roller, wherein said curved surface has a curvature corresponding to a curvature of said lower roller.

* * * * *